United States Patent [19]

Trickel

[11] 4,096,808

[45] Jun. 27, 1978

[54] METHOD AND APPARATUS FOR BURNING AIR-SUSPENDED PARTICULATE FUEL

[76] Inventor: Lorn L. Trickel, 8806 NE. Thompson St., Portland, Oreg. 97220

[21] Appl. No.: 740,862

[22] Filed: Nov. 11, 1976

[51] Int. Cl.[2] ..... F23G 7/00; F23K 3/02

[52] U.S. Cl. ..... 110/244; 110/264; 110/102; 110/104 B

[58] Field of Search ..... 110/7 A, 7 B, 28 A, 110/28 B, 28 H, 110, 102, 104 B

[56] References Cited

U.S. PATENT DOCUMENTS

| | | | |
|---|---|---|---|
| 1,715,584 | 6/1929 | Wetmore | 110/104 |
| 1,769,197 | 7/1930 | Wetmore | 110/104 |
| 1,778,744 | 10/1930 | Adamson | 110/28 H |
| 2,197,647 | 4/1940 | Lorenzen | 110/28 H |
| 3,472,185 | 10/1969 | Burden, Jr. | 110/110 |
| 3,824,937 | 7/1974 | Turner et al. | 110/102 |

*Primary Examiner*—Kenneth W. Sprague
*Attorney, Agent, or Firm*—Eugene D. Farley

[57] ABSTRACT

Apparatus for burning particulate fuels such as wood sander dust or sawdust comprises a pair of radially spaced, substantially coaxial tubes having infeed ends and juxtaposed discharge ends. Mounting means rotatably mount one of the tubes. Drive means is connected to the rotatably mounted tube for rotating it relative to the other tube. A source of forced draft combustion air is connected to the infeed end of one of the tubes. Fuel feed means is arranged for feeding particulate fuel in solid flow into the infeed end of the other of the tubes. Upon establishing concurrent, substantially continuous flows of fuel and air in the respective tubes and spinning one of the tubes, the fuel and air contents of the tubes are discharged at the outfeed ends thereof and mixed with a high degree of efficiency into a combustible fuel mixture.

7 Claims, 5 Drawing Figures

METHOD AND APPARATUS FOR BURNING AIR-SUSPENDED PARTICULATE FUEL

BACKGROUND AND GENERAL STATEMENT OF THE INVENTION

This invention pertains to method and apparatus for burning air-suspended particulate fuels. It pertains especially to method and apparatus for burning with a high degree of efficiency such hard-to-burn particulate fuels as sander dust, sawdust, and heavy oils and combustible sludges.

The combustion of waste particulate combustible materials such as wood sander dust and sawdust is a widely practiced art. It has the beneficial effects not only of disposing of waste products without detriment to the environment, but also of producing heat and energy for industrial and domestic consumption.

Many systems heretofore have been devised for burning such fuels. Those most widely used entrain the fuel particles in a straight-through, non-swirling stream of air and convey it to a burner where it is ignited and burned. Such systems have two important disadvantages.

In the first place, an amount of air is required to convey the fuel which is far in excess of that required to burn the fuel. The excess air cools down the burner and the combustion gases so that the combustion takes place with reduced efficiency.

In the second place, use of conveying air necessarily subjects the conveyed fuel particles to a classifying or winnowing action which tends to separate the fine from the coarse particles. As a result, a non-uniform mixture is conveyed to the burner and the resulting combustion correspondingly is non-uniform. Also, particularly in installations where there are long runs of pipe for conveying the fuel-air mixture to the burner, the heavier particles separate out and tend to plug the ducts in which the mixture is being conveyed.

It accordingly is the general purpose of the present invention to provide improved method and apparatus for burning air-suspended particulate fuels in which the fuel is fed to the burner in a uniform mixture together with the amount of air predetermined for most efficient combustion of the fuel, and without the presence of a large excess of cooling air.

It is another object of the present invention to provide a method and apparatus for the combustion of particulate fuels which is susceptible to precise control of the fuel-air ratio as required for maximum efficiency of combustion.

Still another object of the present invention is the provision of method and apparatus for burning air-suspended particulate fuels which is adaptable for use with a wide variety of particulate fuels, including many categories of industrial waste materials.

Still another object of the present invention is the provision of apparatus for burning air-suspended, particulate fuels which apparatus is simple to construct, easy and reliable to operate, and self-cleaning in operation.

The foregoing and other objects of the present invention are achieved by apparatus which in its broad concept comprises a pair of radially spaced, substantially coaxial tubes having infeed ends and adjacent discharge ends. Mounting means rotatably mount one of the tubes. Drive means is connected to the rotatably mounted tube for rotating it relative to the other tube.

A source of forced draft combustion air is connected to the infeed end of one of the tubes. Solid fuel feed means is arranged for feeding particulate fuel in solid flow into the infeed end of the other of the tubes.

In operation, concurrent, substantially continuous flows of particulate fuel and combustion air are established in the respective tubes. As the tubes discharge into the combustion area, the particles are dispersed uniformly through the combustion air by the air current established by the latter as well as by the spinning motion of the rotary tube. This insures delivery of a uniform mixture of fuel and air to the combustion area, without the presence of a large excess of air which would cool down the combustion gases and reduce the efficiency of the combustion operation.

DESCRIPTION OF A PREFERRED EMBODIMENT OF THE INVENTION

Figure 4:
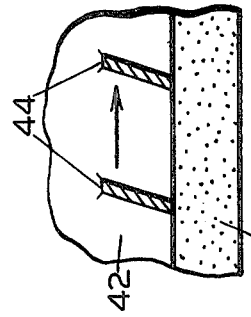
FIG. 4 is a fragmentary detail section taken along line 4—4 of FIG. 3.

As noted above, the method and apparatus of my invention are adapted for burning air-suspended particulate fuels comprising a wide variety of waste materials. Suitable such materials comprise industrial wastes such as sander dust, sawdust, planer shavings, straw, leaves, etc. It also may be applied to dried garbage and other refuse. Where the solid materials are not already in particulate form, they are reduced to the form of particles having maximum sizes of less than about one-eighth inch preliminary to feeding them to the apparatus.

By suitable adaptation, the apparatus of my invention is also adaptable to burning a fuel mixture comprising totally, or partially, waste liquid combustible materials such as waste crank case drainings, heavy oils, and combustible sludges.

As illustrated in the drawings, the apparatus of my invention is mounted on a plurality of upright supports 10, 12, 14, 16. Supports 10, 12 mount a ceramic-lined combustion chamber 18 which in practice is part of, or associated with, the furnace in which the fuel is to be burned. It is fitted with igniter 19.

Supports 14, 16 support a platform 20 and an outwardly extending bracket 22.

The apparatus mounted on this or other suitable framework basically comprises a pair of radially spaced, substantially coaxial, tubes having infeed ends and juxtaposed discharge ends. In the illustrated form of the invention the inner tube 24 is a stationary tube used for conveying a supply of particulate fuel in solid flow.

The tube is open at both ends. Its infeed end communicates with a feed hopper or bin 26 which contains the sander dust, sawdust or other solid particulate fuel and which is equipped with one or more agitators 28 which prevent the fuel from hanging up in the hopper.

A substantial clamp 29 supports tube 24 and maintains it in a fixed position.

The outfeed end of tube 24 communicates with combustion chamber 18, being introduced through a port in the same.

Particulate fuel feed means works in the tube. To this end there is provided a screw 30 including a hollow shaft 32.

A pipe 33 is connected to hollow shaft 32 and communicates with a source of waste liquid fuel at its infeed end. A nozzle 34 is connected to hollow shaft 32 at its outfeed end.

The infeed end of the screw is extended to provide a section which works in hopper 26, thereby providing a means for conveying the fuel from the hopper into the tube. Bearings 36 support the infeed end of the shaft. A motor 38 supported on bracket 22 and connected to the infeed end of the screw by means of a pulley and belt drive 40 provides a means for driving the screw at a predetermined and variable rotational speed. Motor 38 also drives agitator 28 through pulley and belt drive 41.

Forced draft combustion air is conveyed to the burner by means of outer tube 42 which, as noted, is radially spaced from and substantially coaxial with inner tube 24.

Figure 2:
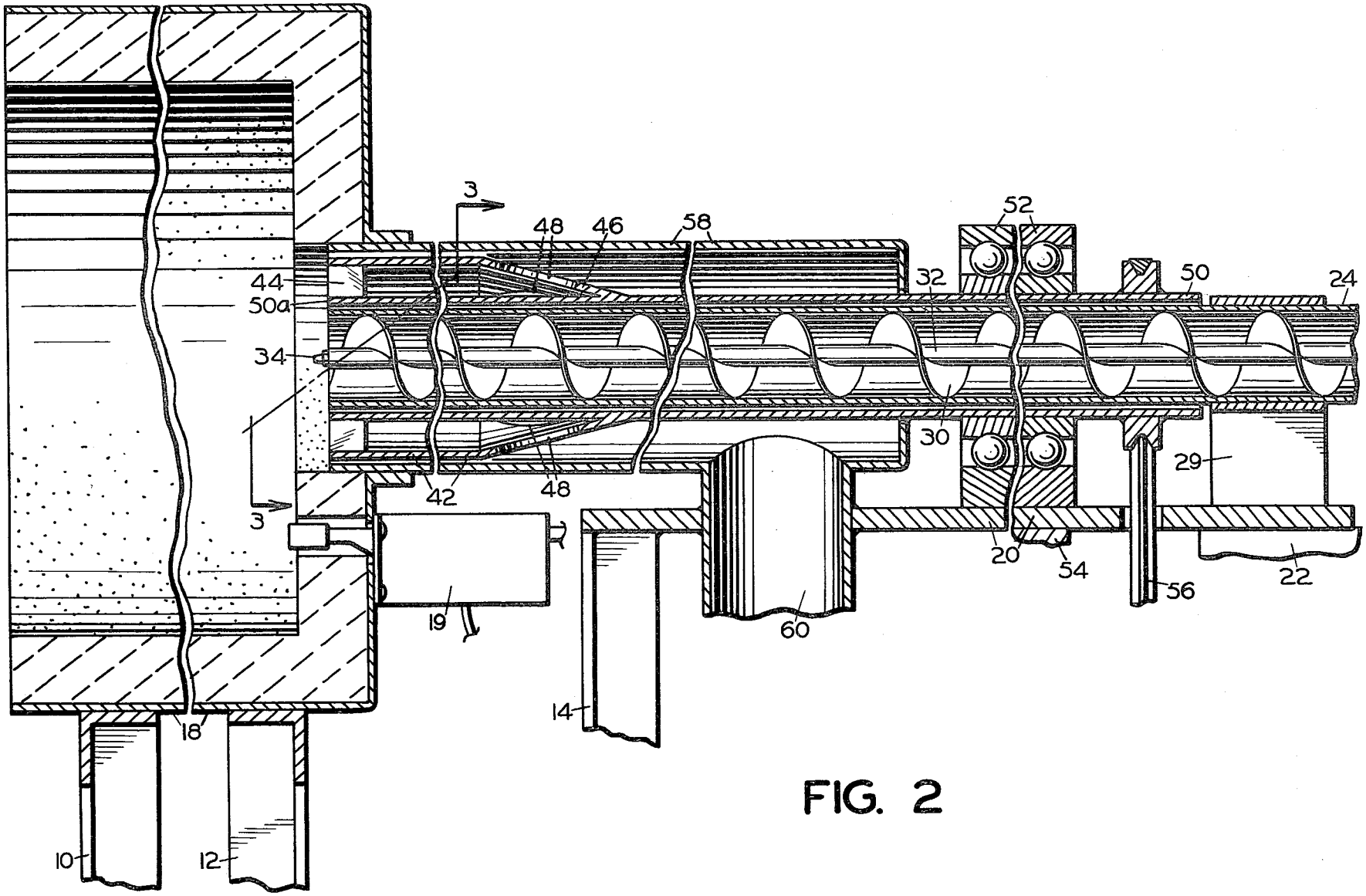
FIG. 2 is an enlarged, foreshortened, longitudinal sectional view thereof.

The outfeed end of outer tube 42 is closely adjacent or juxtaposed to the outfeed end of inner tube 24, as is apparent particularly from a consideration of FIG. 2. The radial spacing between the two tubes is sufficient to convey air in a desired amount for efficient combustion.

Figure 3:
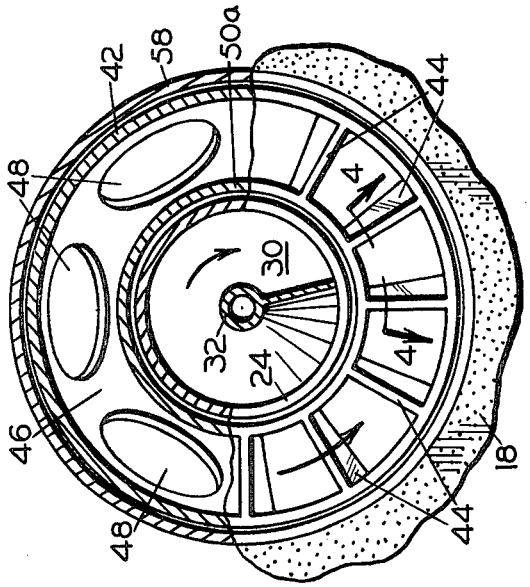
FIG. 3 is a fragmentary sectional view taken along line 3—3 of FIG. 2.

The outfeed end of the outer tube 42 is open and communicates with combustion chamber 18. It is provided with a plurality of inwardly directed vanes 44, FIG. 3, arranged at appropriate circumferential spacings and preferably arranged at a slight angle to the axis of the tube.

Integral with the infeed end of tube 42 is an inwardly tapered section 46. This is provided with a plurality of ports 48.

Mounting means are provided for mounting tube 42 rotatably with respect to inner tube 24.

For this purpose there is provided a shaft 50 which is integral with the infeed end of tapered section 46. The shaft is hollow and coaxial with inner tube 24. A close tolerance is maintained between the hollow shaft 50 and the inner tube 24 which it encases to eliminate the necessity of packing. It will be noted from an inspection of FIG. 2 that the infeed end of the shaft is open.

Shaft 50 is rotatably mounted in a plurality of axially spaced bearings 52. It is driven at a predetermined and variable rotational rate by a variable speed motor 54. The motor is mounted on platform 20 and connected to the shaft by means of a belt and pulley assembly 56.

It is to be noted that rotary shaft 50 is provided with a downstream extension 50*a*, which may be perforate or entire. Its primary functions are to provide a structural support for vanes 44 and to assist in guiding a flow of air through the tube and into the combustion chamber.

Rotatable outer tube 42 is supplied with forced draft combustion air in a manner also evident in FIG. 2.

A plenum 58 surrounds and encloses tube 42 at its tapered section 46. The plenum is fabricated from plates which are arranged and supported in a close tolerance to the outer surfaces of both rotary tube 42 and its shaft 50 to avoid the necessity of providing seals. The plenum terminates in a plenum duct 60. The duct in turn communicates with a source of forced draft combustion air.

Figure 5:
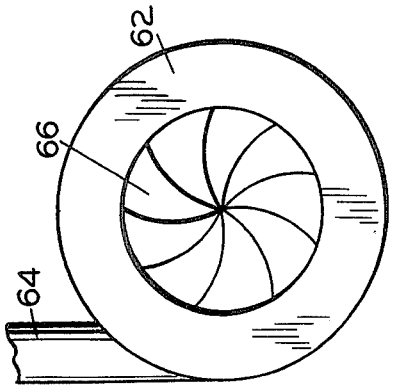
FIG. 5 is a fragmentary elevation looking in the direction of the arrows of line 5—5 of FIG. 1.
Figure 1:
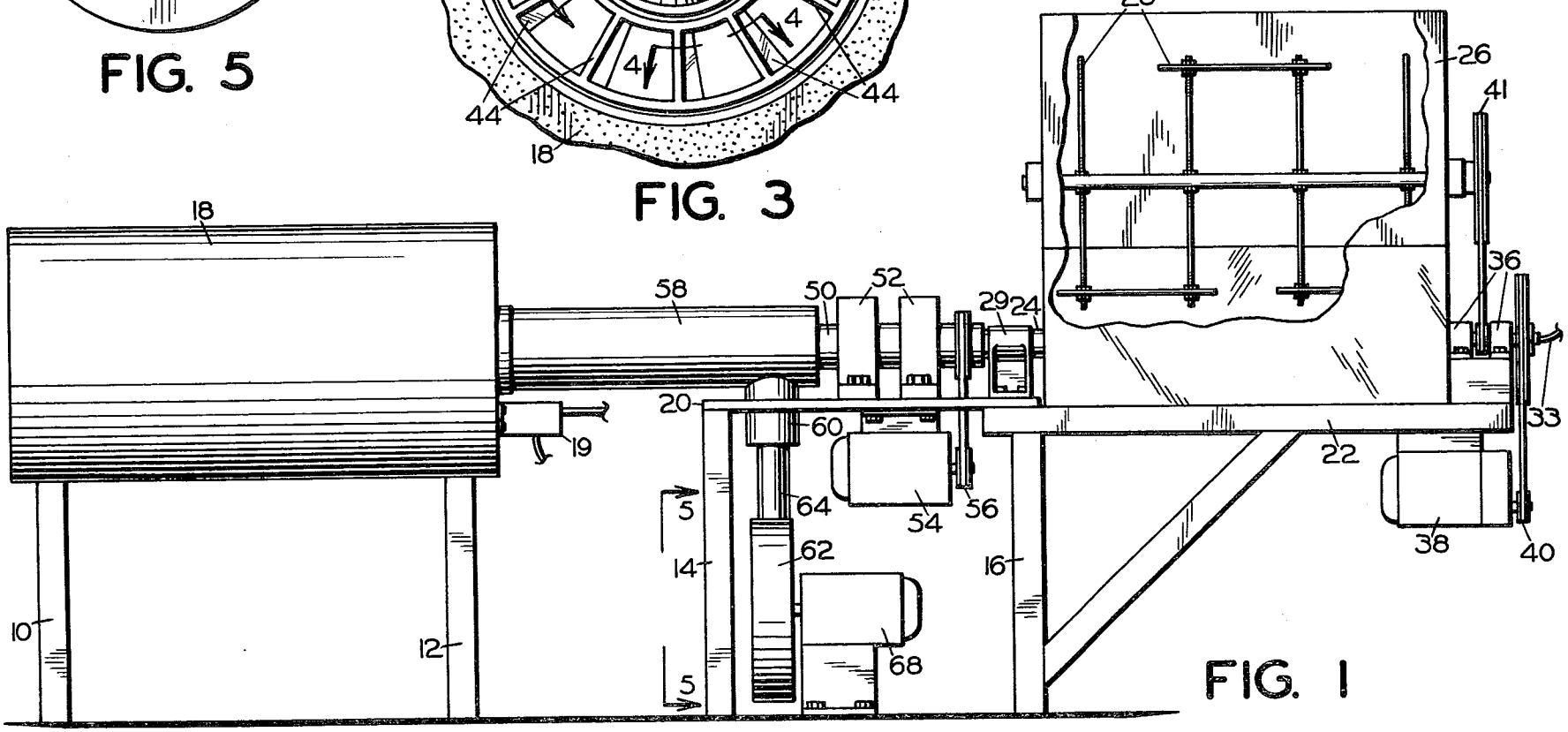
FIG. 1 is a view in side elevation, partly broken away, of the hereindescribed apparatus for burning air-suspended, particulate fuels.

In the illustrated form of the invention the source of forced draft combustion air comprises a fan 62, the exhaust port of which communicates through a pipe 64 with plenum duct 60. The fan is provided with an intake port equipped with an iris 66, FIG. 5, as one means of controlling the air intake and hence the quantity of air supplied to the plenum.

Fan 62 is driven by motor 68. This is preferably a variable speed motor which provides a further means of controlling the amount of air put out by the fan.

All of the above described operational elements, i.e. motor 38, motor 54, iris 66, and motor 68 may be controlled to provide a desired flow rate of solid fuel and combustion air in the desired ratio for obtaining maximum performance efficiency by means of suitable controls mounted on a control panel situated at the operator's station.

OPERATION

The operation of the hereindescribed apparatus for burning air-suspended particulate fuel is as follows.

In one mode of operation, hopper 26 is filled with sander dust, sawdust, or other selected solid particulate fuel. Motor 38 drives screw 30 at a rate predetermined to discharge the desired amount of solid fuel per unit time out of the discharge end of stationary tube 24.

Motor 54 is set to drive rotary tube 42 at the predetermined rotational speed.

Motor 68 and iris 66 are adjusted to supply the desired amount of air in forced draft to plenum 58. This air passes through ports 48 into the interior of rotary tube 42. It exits from the latter through vanes 44 which give to the air a swirling cyclonic motion. Contemporaneously, the solid fuel particles are discharged from the outfeed end of stationary tube 24. They are caught up by, and intimately dispersed in, the cyclonic air stream and thus introduced into the combustion chamber.

In a second mode of operation, waste liquid combustible materials such as crank case drainings and combustible sludges are introduced into the burner via fuel pipe 33 and nozzle 34. This may be done using the liquid combustible material as the only fuel, or using it together with the solid particles to discharge from the end of inner tube 24 a mixture of solid and liquid fuel.

After having been ignited by igniter 19 the fuel burns completely and cleanly with maximum efficiency, with no hangup of solid fuel in conveying ducts, and without the presence of excessive cooling air.

Having thus described my invention in preferred embodiments, I claim:

1. Apparatus for burning air-suspended particulate fuel comprising:

(a) a pair of radially spaced, substantially coaxial tubes having infeed ends and juxtaposed discharge ends, (b) mounting means rotatably mounting one of the tubes, (c) drive means connected to the rotatably mounted tube for rotating it relative to the other of the tubes, (d) a source of forced draft combustion air connected to the infeed end of the rotatably mounted tube, (e) fuel feed means arranged for feeding particulate fuel in solid flow into the infeed end of the other of the tubes, and (f) a plurality of spaced, radially directed vanes secured to the rotatably mounted tube at the outfeed end thereof.

2. The apparatus of claim 1 including a conduit extending through the inner tube and having a discharge nozzle disposed adjacent the discharge ends of the tubes and an infeed end arranged for connection to a source of combustible liquid.

3. Apparatus for burning air-suspended particulate fuels comprising:

(a) a pair of radially spaced, substantially coaxial tubes having infeed ends and juxtaposed open outfeed ends, (b) mounting means rotatably mounting the outer tube, (c) drive means connected to the outer tube for rotating it relative to the inner tube, (d) a source of forced draft combustion air communicating with the space between the tubes, (e) screw means working in the inner tube for receiving particulate solid fuel at the infeed end of the tube and discharging it at the outfeed end thereof, and (f) a plurality of spaced, inwardly directed, longitudinally extending vanes secured to the inner surface of the outer tube at the outfeed end thereof.

4. The apparatus of claim 2 wherein the source of forced draft combustion air comprises a fan, and an air plenum interconnecting the fan and the infeed end of the outer tube.

5. The apparatus of claim 4 including valve means associated with the fan for controlling the forced draft combustion air output thereof.

6. The apparatus of claim 3 wherein the screw means has a hollow supporting shaft, and a conduit extends through said hollow shaft, the conduit having a discharge nozzle disposed adjacent the discharge ends of the tubes and an infeed end extending outwardly of the inner tube for connection to a source of combustible liquid.

7. Apparatus for burning air-suspended particulate fuels comprising:

(a) a pair of nested, radially spaced, substantially coaxial tubes having infeed ends and juxtaposed, open outfeed ends, (b) a plurality of longitudinally arranged vanes extending inwardly from the inner surface of the outfeed end of the outer tube, (c) mounting means rotatably mounting the outer tube, (d) drive means connected to the outer tube for rotating it relative to the inner tube at a predetermined rotational speed, (e) an air plenum communicating with the infeed end of the outer tube, (f) fan means communicating with the air plenum and supplying forced draft combustion air thereto, (g) a screw working in the inner tube and having an extension projecting outwardly from the infeed end thereof, (h) a fuel bin receiving said extension and (i) motor means coupled to the screw for driving it at a predetermined rotational rate.

* * * * *